United States Patent [19]

Diacont, Jr. et al.

[11] 4,395,963

[45] Aug. 2, 1983

[54] METHOD OF MAKING LAP SEAMS

[75] Inventors: George P. Diacont, Jr.; James D. Grisham, both of Richmond, Va.

[73] Assignee: AMF Incorporated, White Plains, N.Y.

[21] Appl. No.: 250,814

[22] Filed: Apr. 3, 1981

[51] Int. Cl.[3] ..... D05B 1/08; D05B 35/02

[52] U.S. Cl. ..... 112/262.1; 112/142; 112/152

[58] Field of Search ..... 112/262.1, 151, 153, 112/147, 152, 154, 148–150, 142; 156/295

[56] References Cited

U.S. PATENT DOCUMENTS

| | | | |
|---|---|---|---|
| 1,439,944 | 12/1922 | Chalman | 112/153 |
| 1,988,401 | 1/1935 | Thompson | 112/151 |
| 2,169,590 | 8/1939 | Myers | 112/262.1 X |
| 4,186,043 | 1/1980 | Zeigler, Jr. et al. | 156/295 X |
| 4,342,613 | 8/1982 | O'Leary et al. | 156/295 X |

*Primary Examiner*—Werner H. Schroeder
*Assistant Examiner*—Andrew M. Falik
*Attorney, Agent, or Firm*—David E. Dougherty; Charles J. Worth

[57] ABSTRACT

A method of making lap seams by providing a constant overlap of the cut edge portions of two pieces of material to be joined together by a seam, stabilizing the overlapping material to prevent relative movement therebetween, rotating the overlapping material causing each piece of material to fold over the cut edge of the other piece of material to form the lap seam, and providing a double row of stitches each extending along a different one of the folded edges of the seam.

3 Claims, 7 Drawing Figures

METHOD OF MAKING LAP SEAMS

This invention relates generally to felling machines and, more particularly, to an improved method of making lap seams of the type normally used in manufacturing jeans, work clothes, and similar articles of apparel.

Up to this time, the usual method of making such lap seams has been to feed the seam edges of two pieces of fabric through a two-section folder to appropriately fold such edges of the material in an interlocking fashion and provide two rows of stitches each adjacent to one of the edges of the formed seam, as shown in U.S. Pat. No. 1,988,401 granted Jan. 15, 1935 to C. S. Thompson. Since folders of this type have no delimiting means for the amount of fabric being inserted into the folder, an experienced operator is required, and even with such quality personnel, many problems are encountered in making lap seams.

If an excessive amount of material is fed into the folder, one or both pieces of material may be double folded resulting in a roping effect or excessively thick lap seams. On the other hand, if an insufficient amount of material is inserted into the folder, the folded edges of the material fails to interlock and a thin seam results. Under these conditions, the short, underfolded material often tends to snap out or unfold between the time the material leaves the folder and the time the seam is stitched resulting in an exposed raw edge.

A further problem encountered is inconsistent lateral spacing between the folded edges of the lap seam since there are no means to restrain the material from relative movement prior to the stitching. As a result, the stitching tends to run off the seam when the width of the seam is too narrow or to be excessively inward of a folded edge when the width of the seam is too wide.

Accordingly, an object of the present invention is to permit the use of relatively inexperienced operators for making lap seams.

Another object of this invention is to provide a method as above in which the seams are of constant width and the material is appropriately folded interlocked.

And still another object of the present invention is to substantially obviate objectionable and reject lap seams.

The foregoing and other objects and advantages will appear more fully hereinafter from a consideration of the detailed description which follows, taken together with the accompanying drawings wherein several embodiments of the invention are illustrated by way of example. It is to be expressly understood, however, that the drawings are for illustration purposes only and are not to be construed as defining the limits of the invention.

Figure 1:
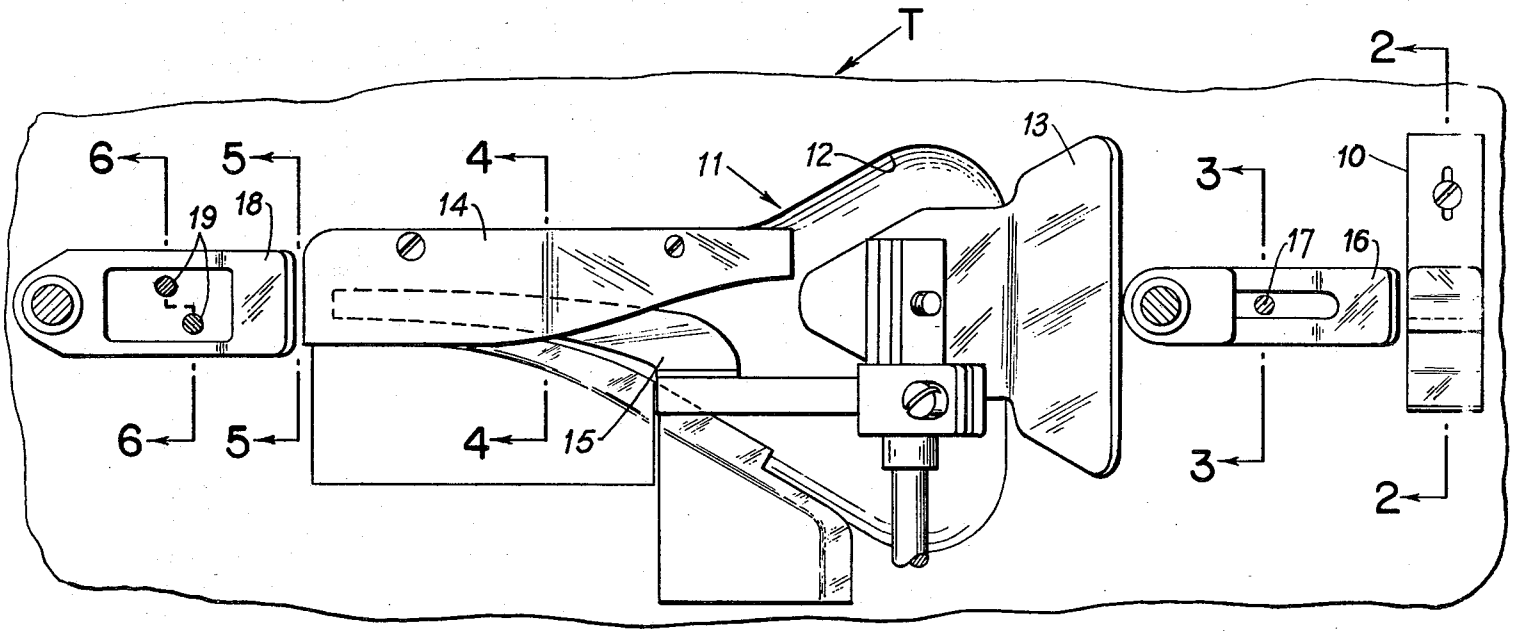
FIG. 1 is a plan view illustrating the equipment for making lap seams in accordance with the present invention.

FIGS. 3, 4, 5 and 6 are sectional views only through the material of a lap seam being made which are taken in the planes defined by lines 3—3, 4—4, 5—5, and 6—6 respectively, of FIG. 1.

Figure 7:
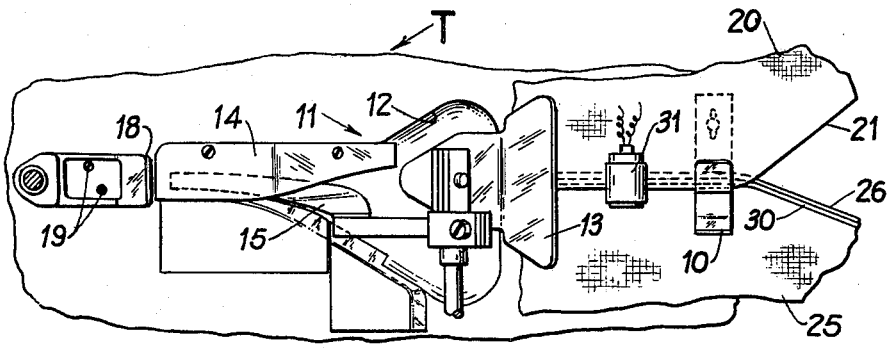

FIG. 7 is a plan view of a modification of the apparatus of FIG. 1.

Referring generally to FIG. 1, it should be noted that the apparatus for making lap seams in accordance with the present invention consists of four major pieces of equipment axially aligned in sequence starting with a double-edge guide 10, a presser foot 16 with a needle bar having a single needle 17, a fold-over assembly 11 and a presser foot 18 with a needle bar having twin needles 19. With the arrangement as shown, the method of making lapped seams can be accomplished at a single station. However, to provide versatility for the stitching equipment, it should be readily understood that the double edge guide 10 may be provided on a single needle machine and the fold over assembly 11 may be provided on a separate twin needle machine at a different location.

Any suitable form of fold-over means may be used. For example, the fold over assembly 11, as shown, is provided with a formed recess 12 in the machine work table T and has a positionable tongue 13 for urging the lapped material down into the recess 12. A fixed blade 14 and an adjustable blade 15 are provided for engaging the cut edges 21 and 26 and the material adjacent thereto for causing the lapped material to rotate or fold 180° as it approaches the presser foot 18 which forms the folded edges 23 and 28 of the lap seam.

Figure 2:
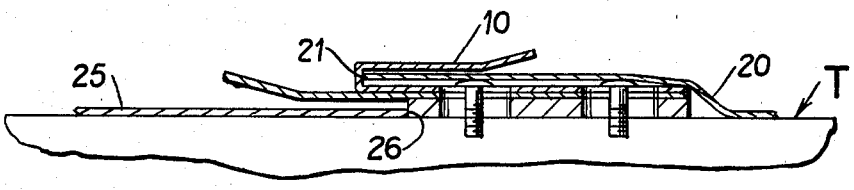
FIG. 2 is an enlarged sectional view taken on line 2—2 of FIG. 1.

In essence, an operator feeds the portions 22 and 27 along the cut edges 21 and 26 or two pieces of cloth 20 and 25 respectively, into a double edge guide 10 as shown in FIG. 2 which may be similar to the edge guide of U.S. Pat. No. 1,439,944 issued Dec. 26, 1922 to J. E. Chalman. The amount of material inserted into the edge guide 10 is limited by the respective edges 21 and 26 which engage vertical surfaces of the guide and the resulting overlap is always of a constant width A as the material issues from the edge guide to the presser foot 16.

Figure 3:
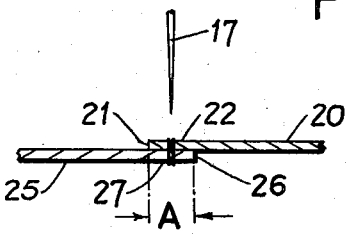

The lapped portion 22 of material 20, and 27 of material 25, are joined by a single row of stitching, as shown in FIG. 3 by needle 17, which is substantially midway between the cut edges 21 and 26. Therefore, the width (A) of the lapped material 22 and 26 which can not shift is held constant as the seam is further processed.

Figure 4:
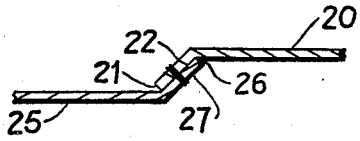
Figure 5:
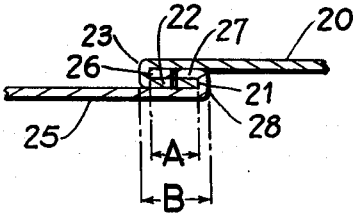

At this point the material as shown in FIG. 3 is stablized and there can be no relative motion between the sheets of material 20 and 25. As the material moves forwardly, the overlap is engaged by the tongue 13 and urged downwardly into the recess 12 of the folder assembly 11. The blades 14 and 15 then engage the edges 21 and 26 of the material 20 and 25, respectively, and the material adjacent thereto causes the stitched overlapped surfaces 22 and 27 to rotate as shown in FIG. 4 to emerge from the folder assembly 11 after the lapped surfaces have rotated 180° as shown in FIG. 5. As shown in FIG. 5, the edges 21 of the material 20 and 26 of the material 25, essentially act as guides for the seam folds 27 and 23, respectively.

Figure 6:
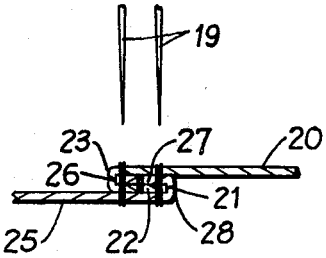

Since the lateral space A between the edges 21 and 26 is constant, the lateral space B between the outer surfaces of the folds 23 and 28 is also constant. The now folded material is then feed to the presser foot 18 and twin needles 19 for final stitching as shown in FIG. 6.

In using this method, it should be readily understood, that by providing a constant overlap between the two pieces of material 20 and 25 and stitching the overlap for stabilization, a continuous seam of constant width and formation results with little skill required for overall operation.

When the material to be joined is suitable for the thermoplastic bonding, a modification of the apparatus of FIG. 1 as shown in FIG. 7 whereby a pair of heated rollers 31 (only the top roller being shown) are interposed between the edge guide 10 and the folder assembly 11 in lieu of the single needle 17, and a thermoplastic material 30 in the form of a tape or powder is applied to the edge portion 27 of the lower layer of material 25 before it is fed to the edge guide 10. As the material 20 and 25 emerges from the guide 10, the lapped portions 22 and 27 are bonded together by action (heat and pressure) of rollers 31 on the thermoplastic material 30 in place of the single row stitching provided by the needle 17 of the apparatus of FIG. 1.

Although several embodiments of the invention have been illustrated and described in detail, it is to be expressly understood that the invention is not limited thereto. Various changes may be made in the design and arrangement of the parts without departing from the spirit and scope of the invention as the same will now be understood by those skilled in the art.

What is claimed is:

1. A method of making a lap seam comprising the steps of:

providing a double edge guide and feeding cut edge portions of two pieces of material to be seamed through the edge guide to provide constant overlapped portions;

joining the overlapped portions together to prevent relative movement therebetween;

providing a fold-over assembly and feeding the joined overlapped portions through the fold-over assembly thereby rotating said overlapped portions 180° folding each piece of material around the cut edge of the other; and providing two rows of stitches each adjacent to the folded material at one side of the seam being made.

2. A method of making a lap seam in accordance with claim 1 further comprising the step of providing a single row of stitches between the cut edges of the material as the overlapped material emerges from the edge guide to prevent relative movement therebetween the overlapped material.

3. A method of making a lap seam in accordance with claim 1 further comprising the steps of providing a thermoplastic between the cut edge portions being fed to the edge guide; and applying heat and pressure as the overlapped portions emerge from the edge guide to bond such overlapped portions together.

* * * * *